United States Patent [19]

Lopez

[11] Patent Number: 4,700,413

[45] Date of Patent: Oct. 20, 1987

[54] TOILET FLUSHING MECHANISM WITH HIGH/LOW WATER VOLUME SELECTABILITY

[76] Inventor: Conrad S. Lopez, 1312 N. Manzanita St., Los Angeles, Calif. 90027

[21] Appl. No.: 861,754

[22] Filed: May 9, 1986

Related U.S. Application Data

[63] Continuation of Ser. No. 679,090, Dec. 6, 1984, abandoned, which is a continuation-in-part of Ser. No. 532,451, Sep. 15, 1983, abandoned.

[51] Int. Cl.[4] ..... E03D 1/36

[52] U.S. Cl. ..... 4/324; 4/415; 137/426

[58] Field of Search ..... 4/324, 415, 661; 137/410, 421, 426; 251/134

[56] References Cited

U.S. PATENT DOCUMENTS

| | | | |
|---|---|---|---|
| 1,078,796 | 11/1913 | Moise | 137/410 |
| 3,038,491 | 6/1962 | Beazley | 137/426 |
| 3,385,317 | 5/1968 | Yankers | 4/661 X |
| 3,896,507 | 7/1975 | Scarritt | 137/426 |
| 3,945,057 | 3/1976 | Therkelsen | 4/324 X |
| 3,956,777 | 5/1976 | Hockly | 137/426 X |
| 4,120,055 | 10/1978 | Mormile | 4/393 X |

FOREIGN PATENT DOCUMENTS

| | | | |
|---|---|---|---|
| 467429 | 6/1937 | United Kingdom | 137/426 |

*Primary Examiner*—Charles E. Phillips

*Attorney, Agent, or Firm*—Beehler, Pavitt, Siegemund, Jagger, Martella & Dawes

[57] ABSTRACT

An articulated float arm for a sanitary toilet flushing mechanism is normally bent at an angle by a detent mechanism to maintain a low water level in the toilet water tank. A linkage is provided to the exterior of the tank for releasing the detent mechanism, allowing the buoyant float to straighten the arm thereby admitting additional water into the tank to obtain more vigorous flushing action.

4 Claims, 7 Drawing Figures

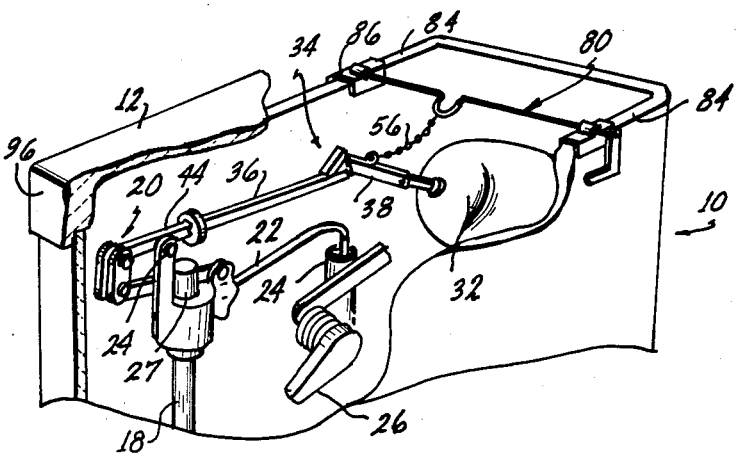
Fig. 4
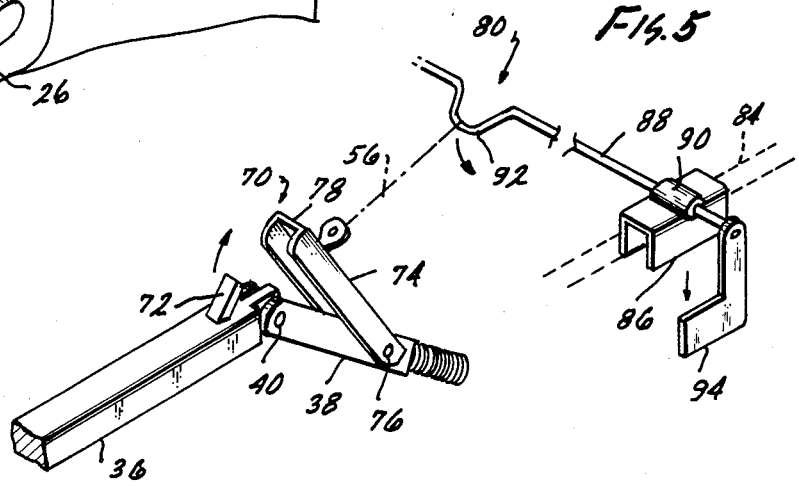
Fig. 5
Fig. 6
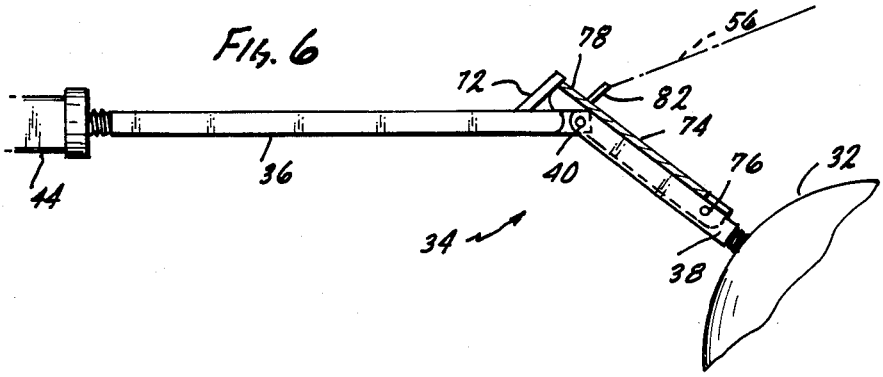
Fig. 7
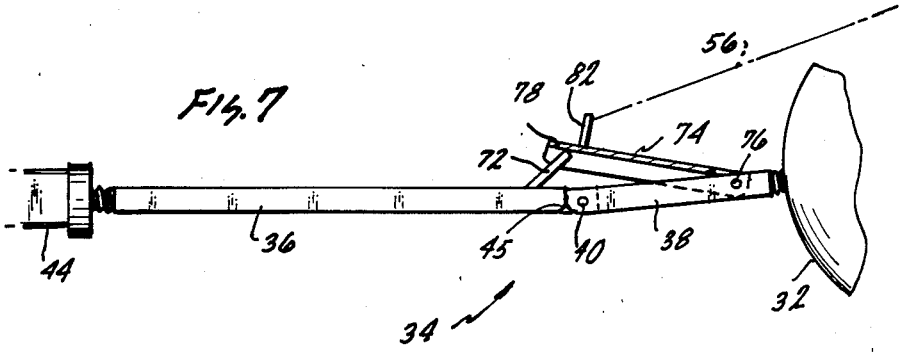

TOILET FLUSHING MECHANISM WITH HIGH/LOW WATER VOLUME SELECTABILITY

This is a continuation of Ser. No. 679,090 filed 12/06/84 which is a continuation-in-part of application Ser. No. 532,451, filed Sept. 15, 1983, both now abandoned.

BACKGROUND OF THE INVENTION

1. Field of the Invention

The present invention relates to flushing mechanisms for sanitary toilets and is more particularly directed to a float arm readily adjustable for maintaining a high or a low water level in the toilet tank so as to reduce water usage.

2. State of the Prior Art

Sanitary toilet flushing mechanisms of various types are known and have been used for many years. One type of toilet mechanism, the ball-float toilet, has been recognized as a standard for many years. In this device, a ball-cock value assembly controls the inlet of water to a water tank. A float ball is connected to the ball-cock valve by means of a float arm. As the toilet tank fills with water, the buoyant float ball rises in the tank, the motion being transmitted to the ball-cock through the float arm until at a predetermined water level the ball-cock assembly shuts off the water inlet to the tank. This corresponds to a generally horizontal position of the float arm. In most toilets, the water level in the water tank may be adjusted by means of a screw set mechanism provided in the ball-cock assembly. This adjustment, however, is limited in range and further requires that the tank lid be lifted to obtain access to the ball-cock. Once the water level in the tank is set, the adjustment is usually ignored thereafter. The same volume of water is therefore discharged from the tank every time that the flush mechanism is tripped, regardless of the volume which may be actually required on a particular occasion in order to successfully flush the toilet.

It is well known that such toilets are wasteful of water since the flushing operation is always carried out with the full capacity of the water tank. Conservation conscious individuals have therefore sought various expedients to minimize water consumption in sanitary toilets. One such measure has been to deposit various objects into the toilet tank, such as bricks or containers filled with water, which serve to displace an equivalent volume of water in the tank thereby effectively reducing the volume of water consumed during each flushing operation. Such measures represent a compromise in that the volume of water in the tank is not readily adjustable and the water consumption may nonetheless be excessive at some times and insufficient on other occasions.

This applicant is not aware of any devices designed to overcome this problem so as to allow ready adjustment of the water level in a sanitary toilet tank, between at least a low level and a high level, so as to suit the requirements of each occasion.

SUMMARY OF THE INVENTION

The present invention overcomes the shortcomings of the prior art by providing a novel float arm which may be installed in a conventional ball-float toilet flushing mechanism as a replacement for the standard float arm provided in commercially available flushing mechanisms.

The float arm with water level selectability of this invention may be generally characterized as having first and second arm sections connected together as by a hinge for flexing movement restricted to a given plane. The first arm section is attachable to the ball cock valve, while the second arm section is attachable to the float. The float arm further includes a latch or detent mechanism which allows the arm to be freely flexed so as to move the first and second arm sections from a first angular relationship through a second angular relationship. However, the latch mechanism locks the arm sections at the second angular relationship when an attempt is made to return the arm sections to the first angular relationship. A release is actuatable for disengaging the latch mechanism to thereby allow the two arm sections to return to the first angular relationship. The first angular relationship may be one in which the two arm sections form a generally straight line, in which the float is allowed to rise to a relatively high level in the water tank, so as to admit a large volume of water into the tank. The second angular relationship may be one wherein the float arm section is bent at an angle of, e.g., 45 degrees away from a straight line with the ball-cock section, although a wide range of angular relationships is contemplated. The second angular relationship is associated with a lower water level in the tank as a result of the float arm being bent downwardly from the ball cock valve so that the float is supported at a lower level in the tank, thus causing the ball cock valve to shut off at a lower water level.

The latch or detent mechanism is such that the float arm will always return to the second angular relationship so as to normally maintain a lower water level in the tank. This is because at each flushing operation, as the water level in the tank drops, the float follows the water level, causing the arm to flex from the first angular relationship past the second angular relationship, before the weight of the float pulls down the arm section connected to the ball cock. This is because the ball cock valve offers an initial measure of support to the arm section connected thereto, which tends to remain horizontal, while the second arm section connected to the float is pulled down by the dropping float, causing the arm to flex at the joint. As the water level in the tank drops past a certain point, the first arm section is also pulled down, causing the ball cock valve to open and admit water into the tank. As water enters the tank, the float again rises and the two arm sections tend to return towards the first angular relationship, i.e., to straighten out under the buoyancy of the float. The detent or latch mechanism, however, moves to a locking position once the two arm sections have flexed past the second angular relationship, and locks to the two arm sections at that second angular relationship against the buoyancy of the float. The arm is thus raised by the float in a flexed condition until the ball-cock arm section reaches its upper limit at which the ball-cock valve shuts off and no more water is admitted into the tanak. The low water level in the tank is thus normally maintained until the latch mechanism is disengaged to thereby allow the float to rise and lift the second arm section towards a more horizontal relationship, into alignment with the first arm section which always returns to the same position after each flushing operation.

The latch mechanism may take a variety of forms, and the latch release may also be adapted to the particular latch mechanism. Generally, the latch mechanism comprises a stop element fixed to one of the arm sections, and a movable latch element mounted to the other arm section. The latch element is in a disengaged position while the arm sections are between the first and second angular relationships, but moves into a locking position upon flexing of the arm sections past the second angular relationship. In this locking position, the latch element engages the stop element at the second angular relationship upon attempted flexing of the arm sections towards the first angular relationship. Desirably, the latch element is spring loaded towards the locking position so as to ensure positive engagement with the stop element. The detent mechanism is linked to the exterior of the water tank so that the float arm angle and consequently the water level may be readily selected without access to the interior of the tank.

The detent mechanism may provide for two or more angular relationships between the two sections of the articulated float arm. For example, one of the selectable positions holds the two sections in a straight line, while the other position drops the section supporting the float arm at an angle to the section attached to the ball-cock inlet valve. The two sections of the float arm may be joined by a simple hinge or a short length of rubber tubing, among other possible means for flexibly joining the two arm sections. The arm is provided with means for holding the arm in the straight line position and a variety of devices may be used for accomplishing this objective. For example, certain commercially available hinges include a built-in stop device which limits the movement of the hinge. Such a hinge may be employed as part of the detent means to limit movement of the two-arm sections at one angle against the buoyancy of the float. If a length of rubber tubing is used to hingedly connect the two-arm sections, a relatively stiff type of rubber tubing may be selected so that the inherent stiffness in the tubing acts as a detent means for limiting movement of the float section in response to the buoyancy of the float. The detent means may further comprise a hook or notched latch element which is pivotably mounted to the ball-cock section of the arm so that it is engageable with a pin projecting from the float section of the arm to lock the float section of the arm against the buoyancy of the ball-float at another angle relative to the ball-cock section. A suitable cable is attached to the latch or hook and is threaded under the lid of the water tank to the exterior such that by pulling on the end of cable, the latch is disengaged from the pin on the articulated arm, to allow the articulated float arm to rise to its straight line position and thereby momentarily opening the ball-cock valve to fill the tank to the higher water level. After flushing, the ball-float drops under its own weight, breaking the straight line of the articulated float arm and allowing the latch to recapture the pin as the water level again rises in the tank, preventing the float arm to rise to its straight position and thus maintaining a low water level in the tank until the cable is again pulled to release the latch detent.

These and other characteristics of the present invention are better understood by reviewing the following figures, which are submitted for the purpose of illustration only and not limitation, wherein like elements are referenced by like numerals, in light of the detailed description of the preferred embodiments.

BRIEF DESCRIPTION OF THE DRAWINGS

FIG. 4 is a perespective view of the improved presently preferred float arm and latch release mechanism installed in a typical sanitary toilet water tank.

FIG. 5 is an enlarged detail view of the arm hinge and improved latch mechanism, and also showing the latch release mechanism.

FIG. 6 is a side elevational view partly in section of the float arm of FIGS. 4 and 5 with the latch mechanism locked in the low water level position.

FIG. 7 is a side elevational view of the float arm of FIGS. 4 and 5 with the latch mechanism in the released position and the float arm in the high water level state.

DETAILED DESCRIPTION OF THE INVENTION

Figure 1:
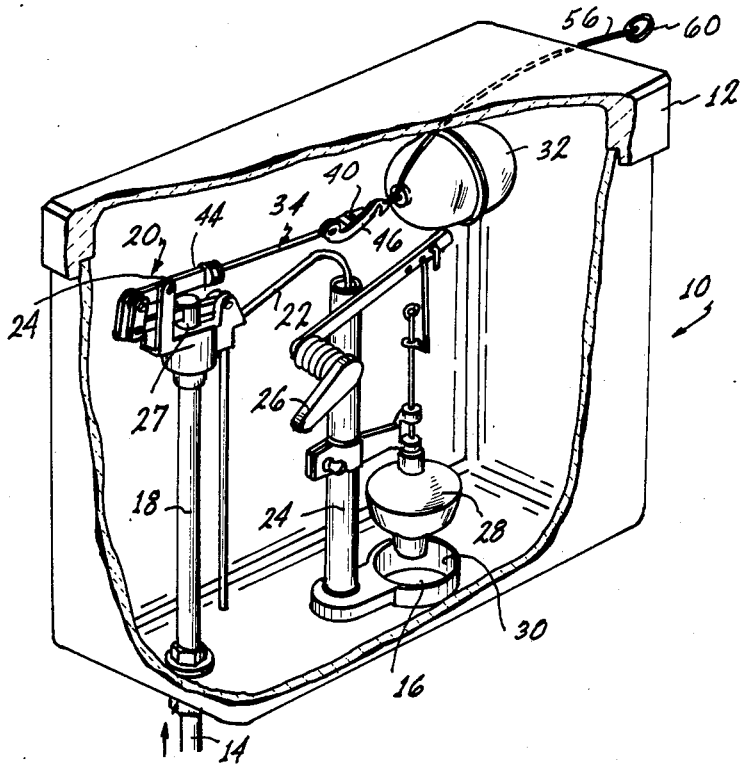
FIG. 1 illustrates a typical sanitary toilet water tank, broken away to show the flushing mechanism equipped with the novel articulated float arm of this invention.

With reference to the drawings and FIG. 1 in particular, a toilet water tank 10 has a lid 12, and is connected to a water inlet conduit 14 and a drain 16. A ball-cock valve assembly 20 is supported at the upper end of water inlet tube 18 connected to the conduit 14. Water flowing through the inlet tube 18 passes through the ball-cock 20 and flows through a filler tube 22 into an overflow tube 25. When the tank is filled with water, the toilet (not shown) may be flushed by operating a trip handle 26 which raises a tank ball 28 from its seat 30 thereby opening the drain and releasing the stored water. The operation of the flushing mechanism is well known and need not be described in greater detail here.

Insofar as is pertinent to the present invention, a ball-float 32 is connected to the ball-cock valve 20 by means of a float arm 34. In conventional mechanisms the float arm consists of a rigid rod of copper or other water resistant material. The ball-cock inlet valve 20 includes a pivot 24 about which the float arm 34 is free to move as the float 32 moves up and down with the water level in the tank 10, in response to rising and falling movement of the float 32. The float arm 34 operates a water inlet valve 27 which closes when the float arm 34 is in a generally horizontal position, this being its upper limit of movement, and which opens whenever the water level in the tank drops so as to allow the float arm 34 to drop from its upper limit position.

Figure 2:
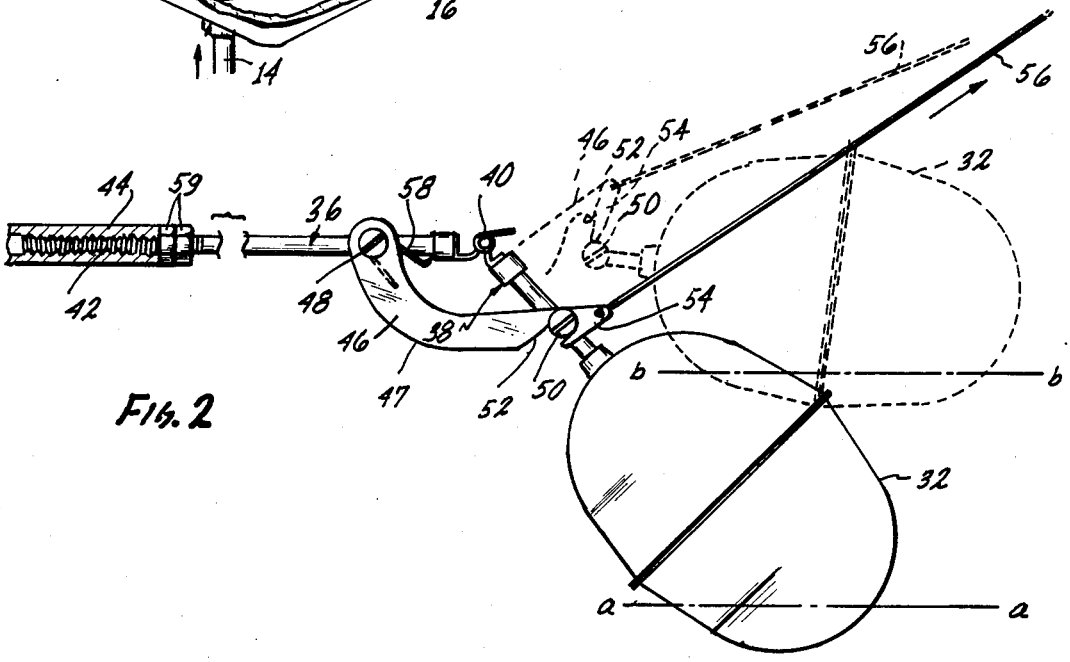
FIG. 2 is a view in side elevation of an articulated float arm according to this invention, showing in dotted lines an alternate straight line position of the float section of the arm.
Figure 3:
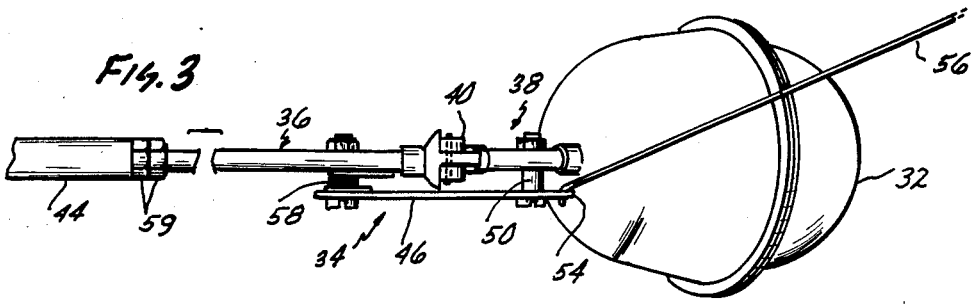
FIG. 3 is a top view of the float arm of FIG. 2.

A first embodiment of the articulated float arm of the present invention is better seen in FIGS. 2 and 3. The arm 34 includes a ball-cock section 36 and a float arm section 38. Each of the two sections is a length of straight rod or tubing joined by means of a hinge 40. The ball-cock section 36 is threaded at its non-hinged end for mounting to a lever 44 of the ball-cock assembly 20, shown only in relevant part in FIGS. 2 and 3. The non-hinged end of the float section 38 supports the ball-float 32.

The hinge 40 is selected and attached to the rod sections such that it does not allow the float section 38 to rise much above a horizontal line with respect to the ball-cock section 36, i.e., the hinge is part of the detent mechanism which locks the two arm sections at one of the two angles, in this case at approximately 180° as shown in dotted lines in FIG. 2. In the alternative any other suitable means may be employed to limit the upward hinging movement of the float arm section 38 relative to the ball-cock section 36.

A latch member 46 is mounted at 48 for pivotal movement relative to the ball-cock section 36. The movement of the latch 46 is substantially limited to a plane parallel to the ball-cock section 36 by the pivot mounting 48. A pin 50 projects from the float section 38 in such a manner that it is engageable by the latch 46 during downward pivotal movement. A notch 52 is formed in the lower edge 47 near the free end 54 of the pivoting latch 46. The notch is cut at an angle so as to capture the pin 50 only during movement towards the free end 54 along the lower edge 47 but not in the opposite direction. The latch 46 and pin 50 thus operate as a detent mechanism which holds the two arm sections at another of two angles, as shown in solid lining in FIG. 2. A flexible line 56 is secured to the free end 54 of the latch 46 and is threaded through an opening formed in the tank 10 or the lid 12, or in the alternative may be threaded through any space or gap that may exist between the lid 12 and the tank 10 as is often the case in such toilet tanks. In either case, the line 56 should slide freely through such opening or gap, so as not to hinder movement of the latch 46 or the float arm 34 in general.

In an initial condition illustrated in dotted lines in FIG. 2 of the drawings, the float 32 and float section 38 of the articulated float arm are in a straight line with the ball-cock section 36, corresponding with a high water level in the tank 10, i.e., a full tank of water. In this condition the notch 52 of latch 46 does not engage the pin 50, the pin being removed towards the free end 54 of the latch, so that it does not underlie the notch 52.

If the toilet is now flushed, the water line drops rapidly, lowering the float 32 and causing the float arm to pivot downwardly. The float section 38 of the arm, in following the downward movement of the float 32 hinges downwardly relative to the ball-cock section 36 of the float arm. The embodiment illustrated in FIGS. 2 and 3 relies on a characteristic of existing toilet flushing systems such as illustrated in FIG. 1, the characteristic being that the ball-cock assembly limits the downward pivotal movement of the float arm. Thus, when the toilet is flushed, the ball-cock assembly will limit the downward movement of the ball-cock arm section 36 short of minimum water level in the tank, thus allowing the float section 38 to continue downward pivotal movement beyond the limit set by the ball-cock assembly 20, resulting in flexing of the arm. The pin 50 moves along the lower edge 47 of the latch 46 towards the pivoted end 48. The ball-cock section of the float arm also drops under the weight of float 32 and float section 38, opening the water inlet valve 27 in the ball-cock assembly 20, allowing water to flow into the tank 10. The water line again rises, lifting the float 32 so that the float section 38 of the float arm pivots upwardly at the hinge 40. The pin 50 now moves in the opposite direction along the lower edge of the latch 46, entering the notch 52. The pin 50 is thus engaged by the latch 46 and the float section 38 is locked against further upward movement relative to the ball-cock section 36, the two sections 36 and 38 being thus held at the angle shown in solid lines in FIG. 2. As the water line continues to rise in the tank 10, the float 32 lifts the angled float arm 34 until the ball-cock section 36 reaches its upper limit of movement, at a generally horizontal position, closing the water inlet valve 27. It will be appreciated that the water line in the tank 10 under such circumstances will be substantially lower than it was in the initial condition where the float arm was in its straight condition shown in dotted lines. The two water lines are suggested by dotted lines a—a and b—b. The difference between the two water levels is determined by various factors, among others the length of the float section 38, the dimensions of the float 32, the shape and size of the latch 46 and particularly the location of the notch 52 along the underside of the latch 46. If desired, more than one such notch may be provided, thereby enabling latching of the articulated float arm 34 at several different angles, each angle corresponding to a different water level in the tank 10.

The latch 46 may be freely pivotable about the pivot axis or pin 48, so that it drops by force of gravity with its lower edge resting on the pin 50. It is preferable, however, to provide a spring 58 mounted for urging the latch 46 downwardly against the pin 50 to assure positive latching engagement of the pin with the latch 46 as the pin moves along the lower edge 47 when the float 32 rises in the tank.

in a condition where the float arm 34 is locked in its angled state and a relatively low water level a—a is maintained in the tank 10, and it is judged that a greater volume of water is required by circumstances, the water level in the tank may be raised to the higher level b—b simply by pulling on the end 60 of the line 56 so as to lift the notched end 54 of the latch 46, to release the pin 50 from the notch 52. The latch 46 is raised to the dotted position in FIG. 2 in response to pulling force on the line 56. This allows the ball-cock section 36 of the float arm to drop since it is no longer supported by the locked buoyancy of the float section 38. The two sections 36 and 38 of the float arm will drop to the limit of movement of the hinge, that is, to a position where the two arms sections 36 and 38 are in a straight line. When the ball-cock section 36 is allowed to drop, the water inlet valve 27 opens to allow additional water into the tank 10. The influx of water will continue until the higher water line b—b is reached and the ball-cock section 36 is again raised to its upper limit to shut-off further flow of water into the tank 10. The trip handle 26 may then be actuated to flush the toilet with the larger volume of water. As the water level falls in the tank, the float 32 will again drop, causing the float arm 34 to bend at the hinge 40, the pin 50 of the float section 38 will again move backwardly along the lower edge of the latch 46 and when the water level in the tank begins to rise as the tank is refilled, the pin 50 will again enter the notch 52, locking the float arm in its angles position and closing off flow of water into the tank at the lower level a—a.

Thus, for the following flushing operation, a reduced volume of water will be released into the toilet unless the line 56 is pulled to disengage the latch 46 from the pin 50. The articulated arm 34 normally maintains the lower water level b—b in the tank 10 unless a higher water line a—a is demanded by pulling on the line 56.

As illustrated in the drawings, both the pivot 48 for the latch 46 as well as the pin 50 projecting from the float section 38 consist of machine screws mounted in bores in the respective sections of the float arm and secured thereto by means of nuts. This is only one possible form of construction and many other alternatives for the pivot mounting of the latch 46 as well as the pin 50 will become apparent to those skilled in the art. Likewise, the hinge 40 is only one possible method of articulating the float arm 34.

In an alternate embodiment of the invention, the two sections 36 and 38 of the float arm are hingedly joined by means of a short length of flexible tubing of rubber or similar material which allows the float section 38 to move through a sufficient arc relative to the ball-cock section 36. In this embodiment, the hinge 40 is eliminated and thus is no longer available to lock the two float arm sections in their aligned, straight position as in the embodiment of FIG. 2. It is thus desirable to provide alternate means for locking the two float arm sections at their second angle, which may be the straight position of the float arm. Such a provision may consist of a second notch on the latch member 46, each of the two notches thus defining two distinct water levels in the tank 10. In the embodiment of FIG. 2, the hinge 40 limits the angular movement of the section 38 relative to the section 36 of the float arm to a single plane which is vertical within the water tank 10. A length of rubber tubing would not so limit the movement of the float section 38 and separate means are then desirable to assure such limitation in order to prevent the pin 50 from laterally escaping engagement with the latch 46. If the float section 38 is allowed to move laterally away from the plane of movement of the latch 46, it becomes possible for the pin 50 to escape the latch and thus defeat the mechanism. One possible means for avoiding this problem is to provide a flat head at the outer end of the pin 50 such that the lower edge 47 of the latch 46 lies against the pin under the urging of spring 58 and is captured between the head 56 and the arm section 38, thereby keeping the section 38 against excessive lateral displacement from the vertical plane.

Desirably, a pair of lock-nuts 59 tightened together on the threaded end 42 of the ball-cock section 36 and positioned to ensure that the articulated float arm 34 flexes in a vertical plane within the tank 10 when the float arm is mounted to the arm 44 of the ball-cock assembly.

It will be appreciated that an effect similar to that obtainable with the embodiment shown in FIGS. 1–3 can be obtained within articulated float arm wherein the float section 38 of the arm moves from a horizontal position, i.e., from being in a straight line with the ball-cock section 36 to an upwardly sloping position rather than the downwardly sloping position shown in solid line in FIG. 2. Thus, the hinge 40 may be selected and mounted in such a way that it prevents the float section 38 from hinging downwardly relative to the ball-cock section 36 and instead is allowed to hinge only upwardly from a horizontal position. Suitable means such as a latch which may be of construction similar to latch 46 in the drawings is then provided to prevent the float arm section 38 from pivoting upwardly relative to the ball-cock section so that the arm is held in a straight configuration which corresponds to a high water level in the tank 10. If a low water level is desired, the latch is disengaged so as to allow flexing movement of the articulated arm. The joint 40 of the arm sinks into the water, such that the ball-cock section 36 of the arm pivots down and opens the water inlet valve 27, admitting additional water into the tank. The float section 38 of the arm is now lifted into an upwardly sloping or even vertical attitude by the buoyancy of the float as water flows into the tank. As the water level rises beyond the initial, low water level the now upwardly bent float arm rises with the water level until the ball-cock section 36 reaches its upward limit of movement and closes the water inlet valve 27 at the new high water level. The difference between the low and high water levels in this alternate embodiment of the invention is determined among other things by the length of the float section 38, and any means which may be provided for limiting the upward slop of the float section 38 relative to the ball-cock section 36 when the latch or detent is released to allow upward pivoting of the float section 38. All other factors being equal, a maximum differential between the low and high water levels is obtained if the float section 38 is allowed to swing to a vertical position, i.e., through a 90° angle from the horizontal to the vertical relative to the ball-cock section 36. A lesser differential between the two water levels is obtainable if the angle of swing of the float section 38 is limited to less than 90°. In this alternative embodiment, the latch structure is suitably modified, e.g., by extending the end 54 of the latch 46 so as to keep the lower edge 47 of the latch member in engagement with the pin 50 as the float section 38 swings upwardly. As the toilet is flushed and the tank is empied of water, the float section will lose is buoyancy and thus swing down to a horizontal position, i.e., in straight line with the ball-cock section 36 and the pin 50 will again engage a notch such as 52 in the latch, so that this alternate embodiment normally maintains a low water level unless a latch or detent is released by suitable means such as a cable or string to allow upward pivotal movement of the float section 38 relative to the ball-cock section 36.

In a further, improved presently preferred embodiment shown in FIGS. 4 through 7, the articulated float arm 34 has been provided with an improved latch mechanism 70, best appreciated in FIG. 5, as well as an improved latch release mechanism 80.

The improved latch 70 includes a stop element 72 which in this particular embodiment takes the form of a rectangular stub extending upwardly from the ball cock arm section 36 and inclined at approximately 45 degrees towards the hinge end of the arm section 36, as best seen in FIGS. 6 and 7. The latch also includes an elongated latch element 74 which is pivotably mounted to the float arm section 38 by means of pivot 76. The free end 78 of the pivotable latch element is thus movable through an arc suggested by the curved arrow in FIG. 5 between a released position in which the latch element 74 moves over the stop element 72, as in FIG. 7, and a locked position in which the latch element 74 engages the stop element as in FIG. 6. The latch element 74 in the particular embodiment illustrated is a channel of U-shaped cross section downturned so as to receive the float section 38. In a first angular relationship of the two arm sections 36 and 38 associated with a high level in the tank 10, and illustrated in FIG. 7, the two arm sections are substantially in line with each other, and supported generally horizontally by the float 32 within the water tank. This condition will exist when the float 32 is supported by a high water level in the tank 10 and the latch 70 has been released. Taking FIG. 7 as an initial condition of the float arm, it is seen that the latch element 74 has been raised away from the float arm section 38 so as to admit the stop element 72 underneath the latch element, which simply rests on the stop element.

When the toilet is flushed, the water level in the tank 10 drops, and the float 32 thus also drops, following the water level. The ball cock valve 26 does provide a certain measure of support to the ball cock arm section 36 due to water pressure in the inlet pipe 18 which resists opening of the valve and requires a certain amount of downward force to be applied at the ball cock arm section 36 before the ball cock valve opens. Thus, as the water level in the tank 10 drops, the ball cock arm section 36 tends to remain horizontal while the dropping float 32 causes the float arm section 38 to pivot downwardly about the hinge 40. The float arm 34 thus flexes from the initial angular relationship shown in FIG. 7 towards and past a second angular relationship illustrated in FIG. 6. As the arm 34 flexes, the latch element 74 slides along the upper end of the stop element 72 until the end 78 of the latch element falls off the stop element and drops so that the latch element 74 lies against and parallel with the float arm section 38, as shown in FIG. 6. The relative dimensions of the various arm components are such that the ball cock section 36 remains substantially unmoved from its upper position shown in both FIGS. 6 and 7 until the latch element 74 moves from the unlocked position of FIG. 7 to the locking position of FIG. 6. As the water level in the tank 10 continues to drop, a point is reached where the weight of the float 32 is transferred to the ball cock section 36, which is thus forced to pivot downwardly about pivot 24 of the ball cock valve. The ball cock valve then opens, admitting water into the tank, which begins to fill again, lifting the float 32. While the buoyancy of the float 32 will tend to straighten the two arm sections 36, 38 towards the first angular relationship of FIG. 7, the end 78 of the latch element 74 will abut against the stop element 72 at the second angular relationship of FIG. 6, and thus prevent the flexible arm from returning to the first angular relationship of FIG. 7. The float arm 34 is thus locked in the bent condition of FIG. 6, and as the float 32 rises with the rising water level, the ball cock arm section 36 is raised to its horizontal shut-off position shown in both FIGS. 6 and 7 at a lower water level than would be the case if the arm were in the substantially straight condition of FIG. 7. Thus, a relatively low level of water is maintained in the tank, so long as the float arm 34 remains in the second angular relationship of FIG. 6.

The low water level condition of the float arm is maintained indefinitely through all subsequent flushing operations. If it is decided that a higher water level is required in the tank 10, additional water may be admitted into the tank 10 by lifting the end 78 of the latch element above the upper end of the stop element 72. The hinge end of the ball cock arm section 36 is now deprived of support from the float's buoyancy and is also weighed down by the hinge end of the float arm section 38. This causes the ball cock section 36 to pivot downwardly, straightening out the float arm 34 towards the first angular position of FIG. 7, and also opening the ball cock valve 20 to admit additional water. The upward flexing limit of the hinge 40 is reached at the angular relationship of FIG. 7, and no further upward flexing of the float arm is possible. Such limit may be provided by abutment of hinge portions 45, as illustrated in FIG. 7, or by any other appropriate means serving to limit upward pivoting of the float section 38 relative to the ball cock section 36. As the water level rises from the low level towards the higher water level, the float 32 also rises, lifting the straightened out arm 34. In this condition, the float arm is raised to the horizontal position of FIG. 7 until the ball cock valve is again shut off at the high water level.

A latch release mechanism is provided by attaching a linkage 56, such as a lightweight chain, cord, etc., to an eyelet 82 affixed to the latch member 74 near the end 78. When pulling force is applied to the linkage 56 with the arm in the condition of FIG. 6, i.e., with the latch mechanism engaged to maintain the low water level, the end 78 is disengaged from the stop member 72, allowing the arm 34 to straighten and admitting additional water into the toilet water tank as has been described.

The latch 70 disengages responsive to a small pulling force on the linkage 56 which may be released immediately as soon as disengagement of the end 78 with the stop element 72 has been achieved. Even if tension is maintained on the linkage 56, this will not normally prevent straightening out of the flexed arm and proper operation of the device. Due to the pivotal mounting 76 of the latch element 74, the float arm section 38 will still pivot upwardly, commencing the sequence of events which leads to admission of additional water into the tank. While the latch release mechanism may consist of nothing more than a cord or chain attached at one end to the latch element 74, and extending to the exterior of the water tank 10, as shown in FIG. 1, a more convenient latch release mechanism 80 may be mounted to the upper edges 84 of the water tank 10 by means of U-shaped mounting clips 86. An actuating rod 88 is rotatably supported between the two clips 86 within tube segments 90 welded to the top of each clip 86. An intermediate portion of the actuating rod 88 is formed into a U-shape 92, which extends radially from the otherwise straight rod 80, and functions as a lever element. The linkage 56 is attached to the middle portion of the U-92, such that when the rod 88 is rotated within its supports 90, the lever 92 pivots and pulls on the linkage 56 to lift the end 78 of the latch element 74 away from the stop element 72 as shown in FIG. 5. Conveniently, an actuating handle 94 may be provided on one end of the actuating rod 80 which extends to the outside of the water tank 10. The mounting clips 86 and the rod support tubes 90 can be made relatively small and thin, so as not to substantially interfere with placement of the usual lid 12, partly shown in FIG. 4, onto the upper edges of the water tank 10. The handle 94 may be made of flat sheet metal which can fit under the lip 96 of the water tank lid 12 and connect to the end of the actuating rod 80. Still other latch release mechanisms will become apparent to those skilled in the art.

At least one locking nut 59 is desirably provided to fix the arm 34 so that it hinges or flexes in a vertical plane within the water tank 10 since a significant deviation from such vertical plane would render the arm inoperative and may lead to overflow of the water tank and consequent flooding.

It must be understood that many alterations, modifications and substitutions may be made by those having ordinary skill in the art to the mechanism of the present invention without departing from the spirit and scope of the invention. Therefore the presently illustrated embodiment has been shown only by way of example and for the purpose of clarity and should not be taken to limit the scope of the following claims.

I claim:

1. A sanitary toilet flushing mechanism with water level selectability comprising:

a water tank;

a water inlet into said tank;

a ball-cock valve normally closing said water inlet;

a float;

first and second arm sections connected for flexing movement in a vertical plane within said water tank;

said first arm section being attached to the ball-cock valve and the second arm section being attached to the float;

latch means allowing flexing movement of said first and second arm sections in one direction from a first angular relationship through a second angular relationship, said latch means locking said arm sections at said second angular relationship against buoyancy of said float urging flexing movement of said arm sections in the opposite direction towards said first angular relationship; and release means connected to said latch means actuatable from the exterior of said water tank for disengaging said latch means to thereby allow said first and second arm sections to return to said first angular relationship;

said release means comprising a pair of clips attachable to the rim of said water tank, an actuating rod rotatably supported between said clips, at least one end of said rod extending to the exterior of said water tank, lever means extending radially from said rod, and linkage means connecting said lever means to said latch means for releasing the latch means upon rotation of said rod.

2. The device of claim 1 further comprising a pair of clips attachable to the rim of a toilet water tank, an actuating rod rotatably supportable between said clips, a lever element extending generally transversely to said rod and affixed thereto, and linkage means for connecting said latch means to said lever element.

3. The device of claim 2 wherein said lever element is an intermediate portion of said rod bent into a U shape.

4. The device of claim 1 further comprising handle means attached to said at least one end of said rod to facilitate manual rotation of said rod.

* * * * *